US005407462A

United States Patent [19]

Areaux

[11] Patent Number: 5,407,462

[45] Date of Patent: Apr. 18, 1995

[54] MASS FLOW GRAVITY FEED METHOD FOR CHARGING METAL-MELTING FURNACES AND APPARATUS THEREFOR

[75] Inventor: Larry D. Areaux, Buena Vista, Colo.

[73] Assignee: Premelt Systems, Inc., Kalamazoo, Mich.

[21] Appl. No.: 240,269

[22] Filed: May 10, 1994

[51] Int. Cl.[6] ..... C22B 9/16

[52] U.S. Cl. ..... 75/581; 75/687; 266/901

[58] Field of Search ..... 266/216, 901, 205, 207; 75/594, 686, 687, 709, 581

[56] References Cited

U.S. PATENT DOCUMENTS

| | | | |
|---|---|---|---|
| 2,402,498 | 6/1946 | Kohlhepp | 75/687 |
| 4,353,532 | 10/1982 | Jay | 75/686 |
| 4,498,523 | 2/1985 | Bowman et al. | 75/687 |
| 4,601,750 | 7/1986 | Robak et al. | 75/687 |
| 4,702,768 | 10/1987 | Areaux | 75/687 |
| 4,710,126 | 12/1987 | Areaux | 432/58 |
| 4,721,457 | 1/1988 | Areaux | 432/58 |
| 4,872,907 | 10/1989 | Areaux | 75/687 |
| 5,211,744 | 5/1993 | Areaux et al. | 266/901 |

*Primary Examiner*—Scott Kastler
*Attorney, Agent, or Firm*—Gordon W. Hueschen

[57] ABSTRACT

A mass flow gravity feed furnace charger comprises a vertically-oriented elongated hollow conduit which is associated with an apertured heat-resistant charge-well cover adapted to lie essentially in contact with the upper surface of a molten metal pool in the charge well of a metal-melting furnace. Presized scrap metal charged into the conduit collects atop the surface of the molten metal pool, since the bottom opening of the conduit communicates with the charge-well cover aperture and permits the metal scrap to fall by gravity directly into the molten metal in the charge well. When the weight of the metal scrap column is sufficient to offset the resistance of the upper surface of the molten metal pool, the weight of the collected metal scrap gravitationally forces it into the molten metal mass where it melts and is assimilated. Employment of the method and charger of the invention enables the controlled introduction of metal scrap by mass flow and gravity feed directly into and beneath the surface of the pool of molten metal and obviates numerous disadvantages and inconveniences of past practices.

41 Claims, 2 Drawing Sheets

MASS FLOW GRAVITY FEED METHOD FOR CHARGING METAL-MELTING FURNACES AND APPARATUS THEREFOR

BACKGROUND OF THE INVENTION

1. Field of the Invention

Utilization of metal scrap, especially presized scrap metal chips or the like of new or used metal, especially brass, aluminum, magnesium, titanium, as well as iron and steel, or an alloy thereof, or a metal for alloying one of said metals, by introduction of said metal scrap into a mass of molten metal of which they are formed or an alloy thereof or for the alloying of the same, and at or below the surface of the molten metal pool in the charge well of a metal-melting furnace. Introduction of metal scrap into the charge well of a metal-melting furnace by a method involving mass flow gravity feed. Apparatus suitable for use in the process.

2. Prior Art

The state of the art has been fully reviewed in my prior U.S. patents, namely, U.S. Pat. Nos. 4,702,768, 4,710,126, 4,721,457, 4,872,907, and 5,211,744, the disclosures of which patents are incorporated herein by reference.

Although the state of the art has been considerably advanced by the procedures and apparatus of these prior U.S. patents, no acceptable method for the mass flow gravity feed of metal chips or scraps to the charge well of a metal-melting furnace, or apparatus suitable for carrying out such a method, has heretofore been available, so far as I am aware. Aside from the totally unsatisfactory early practice of simply throwing metal scraps into a molten metal pool in a charge well, which results in unsatisfactory and uneconomic processing due to unacceptable losses of metal due to oxidation, inadequate melting, settling out, and the like, alternative procedures and apparatus for carrying out such essential introduction of metal scrap have been relatively complex and time-consuming, and an effective method of gravity feeding metal scrap en masse into a molten metal pool in a charge well of a metal-melting furnace, whether a reverberatory furnace, a channel-type induction furnace, or a coreless-type induction furnace, with the highly-desirable advantages of simplicity, rapidity, and economy, but with retention of all of the advantages attributable to previous method and apparatus developments in the area, has simply not been available up to the time of the present invention.

OBJECTS OF THE INVENTION

It is an object of the invention to provide a new and improved method for the utilization of metal scraps which involves feeding the metal scraps directly to a molten metal pool in a charge well of a metal-melting furnace by mass flow gravity feed. Another object is the provision of apparatus suitable for carrying out such a method. An additional object is the provision of such a method and apparatus which involve the employment of suitably apertured charge-well cover means in conjunction with suitable means for forming a substantially-vertically oriented column of metal scrap within and above the aperture of the charge-well cover, which is uniquely and advantageously designed for its intended use. A further object of the invention is the provision of such a suitably apertured heat-resistant charge well cover and the formation of such a substantially vertically-oriented column of metal scrap within and above said aperture, and then feeding additional metal scrap to the column to increase the height and weight thereof until the weight thereof gravitationally forces the metal scrap at the bottom of the column into the molten metal mass in the charge well, as well as the basic and more complex means or apparatus for carrying out the said method. Still other objects of the invention will become apparent hereinafter, and yet other objects will be obvious to one skilled in the art to which this invention pertains.

SUMMARY OF THE INVENTION

What I believe to be my invention, then, inter alia, comprises the following, singly or in combination:

A mass flow gravity feed furnace charger for use in conjunction with the charge well of a metal-melting furnace comprising the following elements in combination:

a heat-resistant charge-well cover adapted to lie essentially in contact with the upper surface of molten metal in the charge well of a metal-melting furnace and adapted to cover a substantial portion of the charge well and having an aperture therein and therethrough;

means for forming a substantially vertically-oriented column of metal scrap within and above said aperture;

means for feeding additional metal scrap to said column to increase the height and weight thereof;

whereby the height and weight of said column can be increased until the weight thereof gravitationally forces said metal scrap at the bottom of said column into the molten metal mass in said charge well; such a mass flow gravity feed furnace charger for use in conjunction with the charge well of a metal- melting furnace comprising the following elements in combination:

a heat-resistant charge-well cover adapted to lie essentially in contact with the upper surface of molten metal in the charge well of a metal-melting furnace and adapted to cover a substantial portion of the charge well and having an aperture therein and therethrough;

an elongated substantially vertically-oriented scrap metal feed conduit having a hollow interior and an upper and lower portion;

metal scrap feed means in association with said upper portion of said conduit and adapted to feed metal scrap thereinto;

said lower portion of said conduit being in association with said charge-well cover and the hollow interior thereof being in communication with the aperture in said charge-well cover;

whereby metal scrap can be loaded into the upper portion of said conduit and collected within said conduit until the weight thereof gravitationally forces said metal scrap into the molten metal mass in said charge well; such an apparatus wherein at least the lower portion of said conduit and associated charge-well cover are moveable vertically into and out of proximity to and contact with the upper surface of the molten metal in the charge well and including means for effecting such movement; such an apparatus including hydraulic or pneumatic means for effecting said movement; such an apparatus wherein said conduit comprises two separate sections, an upper section and a lower section; such an apparatus wherein portions of said sections are in up and down moveable relationship with respect to each other; such an apparatus wherein portions of said sections are in slidable up and down moveable relationship with respect to each other and including hydraulic or pneumatic means for effecting said up and down movement with respect to each other; such an apparatus wherein said pneumatic or hydraulic means is activated by one or more probes associated with the level of molten metal in said charge well; such an apparatus wherein said up and down movement is activated so as to maintain said charge-well cover at the bottom of said conduit essentially in contact with the upper surface of molten metal in said charge well; such an apparatus wherein said conduit is supported by support means at an upper end thereof; such an apparatus wherein an upper end of said conduit is secured to a horizontal portion of said support means; such an apparatus wherein an opening at an upper end of said conduit is enlarged to facilitate the introduction of metal scrap thereinto; such an apparatus wherein said conduit comprises an upper fixed section and a lower section in slidable relation thereto over a portion thereof, to enable relative up and down movement of said lower section with relation to said upper fixed section; such an apparatus wherein said relative up and down movement is effected by fluid-actuated cylinders connected to one of said sections having outwardly-extending piston rods connected to the other of said sections; such an apparatus wherein said movement is controlled with relation to the level of molten metal in said charge well by a sensor associated with said charge well cover at the bottom of said conduit; such an apparatus wherein said sensor activates said charge-well cover to descend, stop descent upon contact with the upper surface of molten metal in said charge well, rise a short distance, and then to descend a predetermined distance after a predetermined period; such an apparatus wherein said conduit is secured to said heat-resistant charge-well cover; such an apparatus comprising an inert gas inlet into the interior of said conduit; such an apparatus comprising a feed sensor associated with said conduit for controlling introduction of metal scrap feed into the conduit; such an apparatus comprising upper and lower feed sensors associated with said conduit for slowing metal scrap feed into the conduit when a column of metal scrap built up in the conduit reaches the level of said lower sensor and for shutting off metal scrap feed when a column of metal scrap built up in the conduit reaches the level of said upper level sensor; such an apparatus comprising a retract switch and associated circuitry for raising the conduit and associated charge-well cover to an out-of-service position above the charge well; and such an apparatus in place atop the charge well of a metal-melting furnace wherein the molten metal and the scrap charged thereinto comprises aluminum, magnesium, titanium, brass, iron, or steel, or an alloy thereof, or a metal for alloying one of said metals.

Moreover, a method for the introduction of metal scrap by mass flow gravity feed into molten metal in a charge well of a metal-melting furnace comprising the following steps:

providing a heat resistant charge-well cover adapted to cover a substantial portion of the charge well and having an aperture therein and therethrough;

forming a substantially vertically-oriented column of metal scrap within and above said aperture;

feeding additional metal scrap to said column to increase the height and weight thereof; and increasing the height and weight of said column until the weight thereof gravitationally forces said metal scrap at the bottom of said column into the molten metal mass in said charge well; such a method for the introduction of metal scrap by mass flow gravity feed into molten metal contained in the charge well of a metal-melting furnace comprising the following steps:

providing a heat-resistant charge-well cover adapted to lie essentially in contact with the upper surface of molten metal in the charge well of a metal-melting furnace and adapted to cover a substantial portion of the charge well and having an aperture therein and therethrough;

providing means for forming a substantially vertically-oriented column of scrap metal within and above said aperture;

providing means for feeding additional metal scrap to said column to increase the height and weight thereof;

forming said column and feeding said additional scrap;

thereby increasing the height and weight of said column until the weight thereof gravitationally forces said metal scrap at the bottom of said column into the molten metal mass in said charge well; such a method including the steps of:

providing a heat-resistant charge-well cover adapted to lie essentially in contact with the upper surface of molten metal in the charge well of a metal-melting furnace and adapted to cover a substantial portion of the charge well and having an aperture therein and therethrough;

providing an elongated substantially vertically-oriented scrap metal feed conduit having a hollow interior and an upper and lower portion;

providing metal scrap feed means in association with said upper portion of said conduit and adapted to feed metal scrap thereinto;

said lower portion of said conduit being in association with said charge-well cover and the hollow interior thereof being in communication with the aperture in said charge-well cover; and loading presized metal scrap into the upper portion of said conduit and collecting said metal scrap within said conduit until the weight thereof gravitationally forces said metal scrap into the molten metal mass in said charge well; such a method including the step of moving at least the lower portion of said conduit and associated charge-well cover vertically into and out of proximity and contact with the upper surface of the molten metal in the charge well; such a method wherein said movement is effected hydraulically or pneumatically; such a method wherein said conduit comprises two separate sections, an upper section and a lower section, and wherein portions of said sections are in up and down moveable relationship with respect to each other, and including the step of moving said sections with respect to each other; such a method wherein said conduit comprises two separate sections, an upper section and a lower section, wherein portions of said sections are in up and down moveable relationship with respect to each other, and including the step of effecting said up and down movement with respect to each other hydraulically or pneumatically; such a method including the step of activating said pneumatically or hydraulically effected movement in relation to the level of molten metal in said charge well; such a method wherein said up and down movement is activated so as to maintain said charge-well cover at the bottom of said conduit essentially in contact with the upper surface of molten metal in said charge well; such a method wherein said conduit comprises an upper fixed section and a lower section in slidable relation thereto over a portion thereof, to enable relative up and down movement of said lower section with relation to said upper fixed section; such a method including the step of effecting said relative up and down movement by fluid-actuated cylinders connected to one of said sections having outwardly-extending piston rods connected to the other of said sections; such a method including the step of controlling said up and down movement with relation to the level of molten metal in said charge well; such a method including the steps of stopping descent of said cover upon contact with the upper surface of molten metal in said charge well and stopping ascent of said charge-well cover in said charge well after a predetermined rise; such a method including the step of activating said charge-well cover to descend a predetermined distance after a predetermined period; such a method including the step of introducing an inert gas into the interior of said conduit; such a method including the step of controlling the rate of introduction of scrap metal feed into the conduit; such a method including the steps of slowing scrap metal feed into the conduit when a column of metal scrap built up in the conduit reaches a first level and shutting off metal scrap feed when a column of metal scrap built up in the conduit reaches a second and higher level; and such a method wherein the molten metal and the metal scrap charged thereinto comprises aluminum, magnesium, titanium, brass, iron, or steel, or an alloy thereof, or a metal for alloying one of said metals.

BRIEF DESCRIPTION OF THE DRAWINGS

Reference is now made to the drawings, wherein.

DETAILED DESCRIPTION OF THE INVENTION

The present invention, in both its method and apparatus aspects, will be more readily understood from the following detailed description, particularly when taken in conjunction with the drawings, in which all of the significant parts are numbered and wherein the same numbers and letters are used to identify the same parts throughout.

Figure 2:
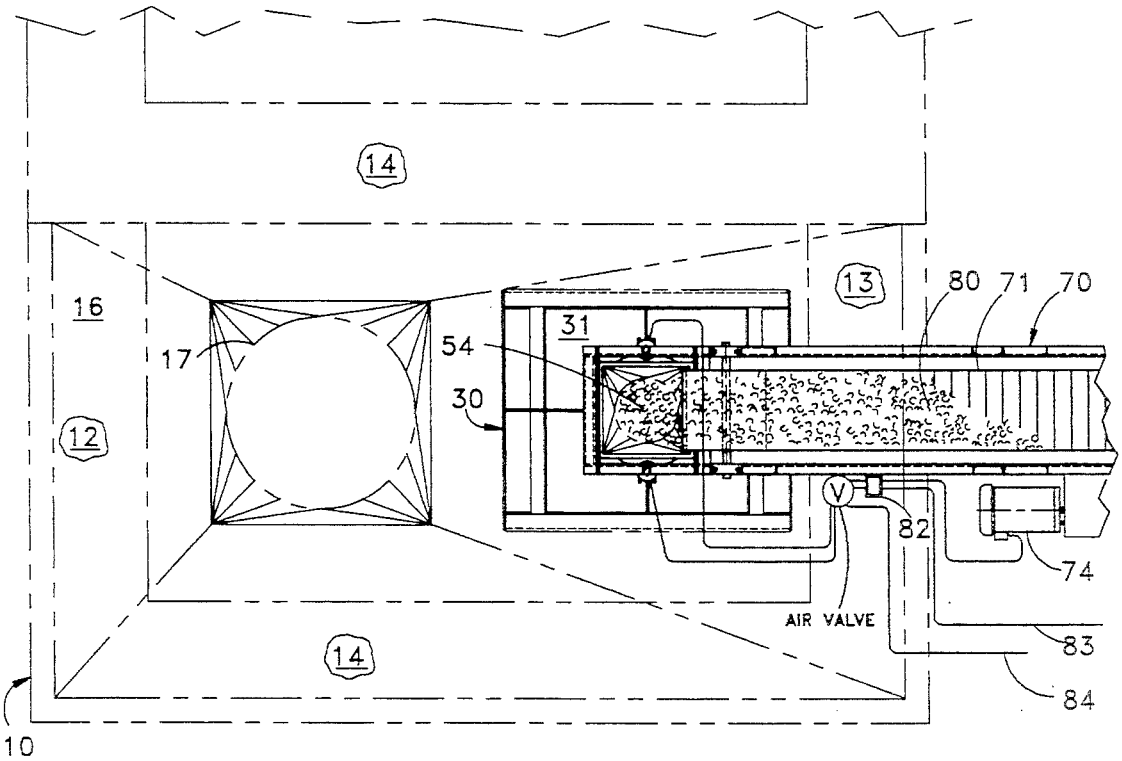
FIG. 2 is a top plan view taken along the line A—A of FIG. 1 showing apparatus according to the invention and illustrating the method of the invention in which the mass flow gravity feed charger and charge-well cover of the invention are again associated, the apparatus and especially the charge well of the furnace again being shown partially schematically.

The charge-well of a metal-melting furnace, e.g., a reverberatory furnace of refractory material or having the usual refractory lining and fired by combustion burners fed by natural gas or fuel oil or the like which throw flames into the interior of the main chamber of the furnace through flame-introduction means, is shown generally in the figures at 10. The charge well 10 comprises base portion or bottom wall 11 and vertical walls 12, 13, and 14. The charge well cavity is shown at 20 with a mass of molten metal, preferably and usually aluminum, magnesium, titanium, brass, or an alloy thereof, therein being shown at 22. The main chamber MC of the furnace as well as chamber extensions, circulation well CW, and communicating passageways are usual and well-known in the art and are not shown or not shown in detail. Ordinarily, the charge well is situated between a circulation well CW and the main chamber MC in such a furnace. However, the configuration of the furnace shown schematically in the figures. and especially in FIG. 2 is merely representative inasmuch as the exact configuration of the furnace is entirely optional, a circulation well not always being required and the number of passageways between chambers and the size thereof being varied widely in the art. The point of introduction of a charge of new or used metal scrap into a reverberatory furnace is in any case at a charge well 20 via some sort of a charging means, as is well known in the art, for example from my previous U.S. Pat. No. 5,211,744. It is at the charge well that the charging apparatus and method of the present invention are importantly operative and applicable.

In the illustrated case, the molten metal mass or pool 22, e.g., the brass, aluminum, magnesium, titanium, iron, or steel, or an alloy thereof, or a metal for alloying one of said metals, is shown as having an upper surface 23, upon which is superposed charge-well cover 30 comprising upper steel structure 31 and lower ceramic structure 32 for the retention of gasses or vaporous materials, such as inert gas supplied to the charge well or gas comprising vaporized impurities or contaminants present on the chips or other scrap metal charged into the molten metal pool 22. As shown in the drawings, cover 30 may advantageously comprise a flat steel plate 31, having refractory material 32 secured therein or clad thereto, or otherwise constituted as such a charge-well cover is described in my previous U.S. Pat. No. 5,211,744. Charge-well cover 30 preferably covers the entire upper surface of charge-well cavity 20, when possible or convenient, and in any event covers as much of the surface of charge-well cavity 20 as is possible and convenient, and in all cases is adapted to cover a substantial portion of the surface of charge-well cavity 20.

As shown, cover 30 is provided with central aperture 33 and upper metal surface 31 thereof may be provided with metal edging 34, angle iron supports 35, and flanges 36 for connection by nuts and bolts, rivets, or other suitable fastening means to flanges 56 provided on the vertically-disposed conduit 51 of the mass flow gravity feed furnace charger, shown generally at 50, situated thereupon. Conduit 51 as shown is cylindrical but may have any other suitable cross-section so long as it is hollow to allow free fall and gravity feed of metal scrap feed 80 in the interior 511 thereof.

The substantially vertical or in any case vertically disposed conduit 51 of the mass flow gravity feed furnace charger 50 is thus associated and connected at its bottom end 52 with charge-well cover 30 and extends to, at least partially into, or even through central aperture 33 therein. Simultaneously, conduit 51 is supported at its upper end 53 by support frame 60 having vertical segment 61 and horizontal segment 62 upon which latter segment are located scrap metal feed conveyor 70 comprising feed conveyor belt 71 and rotatory drum 72 mounted for rotation on support means 73 and associated with feed conveyor motor 74, all located generally atop horizontal portion 62 of frame 60. Metal scrap feed, especially presized scrap feed, 80 proceeds along belt 71 of the feed conveyor 70 and over drum 72 into upper loading aperture 54 of mass flow gravity furnace charger 50 conduit 51, as shown having an enlarged opening 54 for input of presized scrap feed 80 at its upper end.

Charge well 10 and adjacent portions of the furnace are surmounted by a hood 16 terminating in hood exit flue 17 and equipped with the usual fans or the like for exit of effluent gasses and vapors from the furnace and especially from charge well 10 thereof. Mass flow gravity furnace charger conduit 51 extends through an aperture 18 in hood 16. Conduit 51 as shown is cylindrical but may have any other suitable cross-section so long as it is sufficiently hollow to allow free fall and gravity feed of metal scrap feed 80 in the interior 511 thereof.

Mass flow gravity feed furnace charger 50 is advantageously provided with several sections of conduit 51, an upper fixed portion 55 and a lower slidable portion 56, lower portion 56 preferably being of somewhat greater dimensions than upper fixed portion 55 so as to be slidable thereover at least in an overlapping slidable area designated 57. Preferably also at least the lower slidable portion 56 is somewhat flared so as to be of greater dimensions at its lower end 52 than at its upper end 58(58), and upper fixed portion 55 may be of either increasing dimensions toward its lower end or of uniform cross-sectional dimension throughout, so long as lower slidable portion 56 is slidable thereover in the overlapping slidable area designated 57.

Upper fixed portion 55 is connected to lower slidable portion 56 by means of level cylinders 59, which may be either air cylinders or pneumatic cylinders, having the usual internal piston (not shown) and piston rod 80 attached to the upper portion 55 near upper end 58 of lower slidable portion 56 by attachment means 81 of any convenient type. Level cylinders 59 are actuated by valve V in association with charger level control 82, all connected by appropriate circuitry to a source of power 83 and fluid line 84 which may conveniently be the plant air supply line or a pneumatic line as desired for actuation of level cylinders 59. Charger level control 82 is in connection with level power circuitry 85 which is in turn connected to level probes LP1 and LP2, LP2 being located at a higher level than LP1, both located on charge well cover 30. The vertical elevation of charge well cover 30 is thus controlled by level probes or sensors LP1 and LP2 in association with level power circuitry 85 to charger level control 82, in turn controlling valve V monitoring and controlling fluid line 84 supplying fluid to level cylinders 59 by means of upper level cylinder inlet 59*a* and lower level cylinder inlet 59*b*.

Lower slidable portion 56 of conduit 51 of mass flow gravity furnace charger 50 comprises upper feed sensor 51*a* and lower feed sensor 51*b*, in turn connected by appropriate circuitry 95 to feed control 92 and to a source of power 93 as well as to feed conveyor motor 74 which is controlled by feed control 92 as actuated by upper and lower feed sensors 59*a* and 59*b*. Equivalent mechanical means, such as a hand or motorized winch and cable or a motorized ball screw (in place of cylinders 59 and rods 80), for raising and lowering lower conduit portion 56 or even the entire conduit 51 may be employed and will be apparent to one skilled in the art in view of the present disclosure.

Toward the lower end 52 of conduit 51 is located inert gas inlet 99 for feeding inert gas into the interior 511 thereof and, as will be apparent from the drawings, the open lower end 510 of mass flow gravity furnace charger conduit 51 corresponds and communicates with aperture 33 in charge well cover 30, thus permitting the presized metal scrap 80 fed into the system to fall directly to or toward the bottom end 52 of the conduit or cylinder 51 of mass flow gravity furnace charger 50 and directly into the molten metal bath 22 in charge well cavity 20 and to sink thereinto as soon as the weight thereof, as accumulated in mass flow gravity furnace charger conduit interior 511, is sufficient to overcome the resistance provided by the molten metal 22 at the upper surface 23 thereof.

Figure 3:
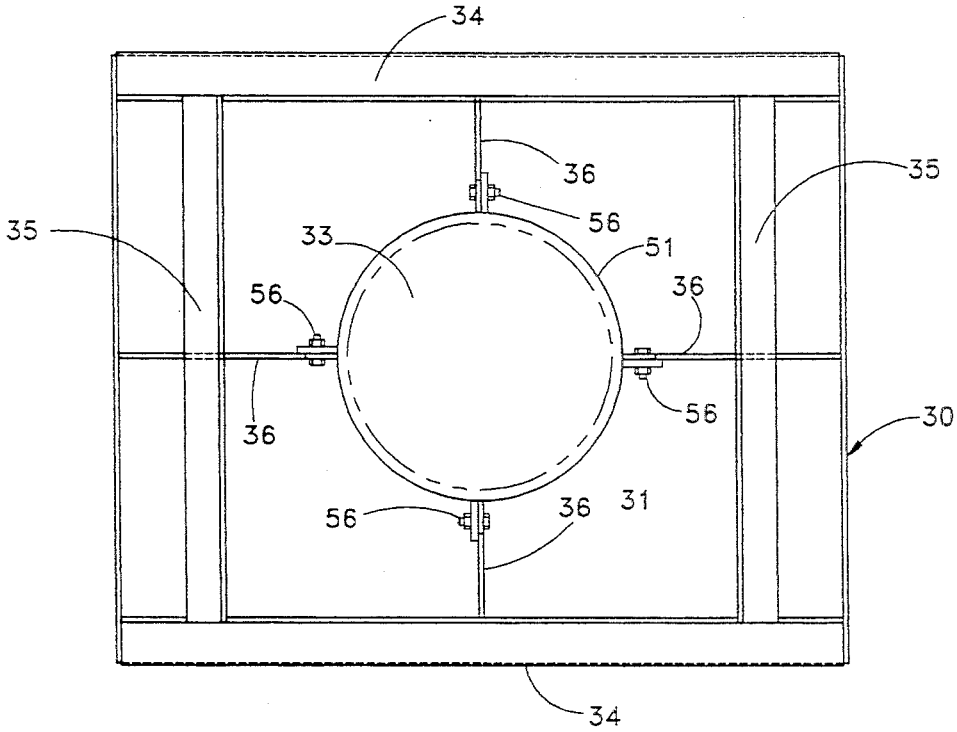
FIG. 3 is an enlarged top plan view taken along line B—B of FIG. 1 of a charge-well cover having a central aperture, both being essential elements according to the invention.

From FIG. 3, a top plan view of the charge-well cover 30, can be seen metal edging 34 and angle iron supports 35 atop metal cover plate 31 as well as the centrally-located aperture in charge-well cover 30 identified as 33.

Extending from the side walls of the mass flow gravity furnace charger 50 conduit 51 are flanges 56, which are secured by suitable securing means such as nuts, bolts, rivets, welding, or the like to corresponding flanges 36, in turn secured by welding or the like to the metal cover plate 31 of charge-well cover 30, and optionally also secured at the outward ends of flanges 36 by welding or the like to upturned inner portions of angle iron supports 35 at two sides and to the metal edging 34 at the other two sides of metal cover plate 31.

OPERATION

In operation, the conduit 51 of mass flow gravity furnace charger 50 of the invention is first suitably located atop charge-well cover 30 and charged with presized metal scrap 80 from feed conveyor 70. Alternatively or additionally, to prevent oversize scrap pieces from entering the upper loading aperture 54, grizzly bars or other similar structure for screening out oversized scrap pieces may be provided, especially if upstream presizing means for so doing is not by itself adequate. Metal scrap in the form of presized scrap feed 80 proceeds from feed conveyor 70 along feed conveyor belt 71 operated by feed conveyor motor 74 and over feed conveyor drum 72 and falls directly into upper loading aperture 54 of vertical cylinder or conduit 51 of the mass flow gravity furnace charger 50.

As the presized scrap 80 collects at and near the bottom end 52 of conduit 51, it is forced by gravity through upper surface 23 of the molten metal pool and slowly dissolves in the molten metal 22. In actual practice, using a flared cylindrical conduit 51 of a diameter of about 14 inches ID, it requires about three (3) feet of presized metal scrap, having a density of about 46 pounds per cubic foot, to force the scrap into the molten metal mass 22 in charge well cavity 20.

A manual switch activates or reactivates feed conveyor motor 14 whereupon feed charger 70 proceeds to feed metal scrap 80 into the upper loading aperture 54 of conduit 51. Lower sensor **51*b* senses the height of a column of feed scrap 80 in interior 511 of conduit 51 when it reaches its position in conduit 51 and slows down the rate at which feed 80 is charged by feed charger 70 through the intermediary circuitry 95 and feed control 92. When the height of the column of feed scrap 80 in conduit 51 interior 511 reaches sensor 51*a*, this signifies that the height of the column of metal scrap 80 in conduit 51 has exceeded that amount which can rapidly and readily be assimilated into metal pool 22, whereupon sensor 51*a* shuts off feed conveyor motor 74 and feed charger 70 through intermediary circuitry 95 and feed control unit 92. When additional feed metal scrap 80 is required, the manual switch is again thrown and activates or reactivates feed conveyor motor 74, again through the intermediary of the feed control 92 and associated circuitry 95 including the necessary circuitry to a source of power 93**.

For best operational results, it is desirable that the charge well cover 30 rest essentially upon the upper surface 23 of the molten metal pool 22, where underlying molten metal and scrap is essentially free of oxidation due to gasses vaporizing from impurities on the feed metal scrap 80 charged into the pool as well as due to the inert gas charged into the interior 511 of charger conduit 51 through inert gas inlet 99. By maintaining the refractory-lined bottom surface 32 of cover 30 in contact with the upper surface 23 of the molten metal pool 22, an air seal is provided so that the inert gas introduced through inert gas inlet 99 can provide a positive pressure inside the conduit interior 511 which causes the flow of oxygen-containing air and some nitrogen to exit from the top of the charger conduit 51. A conventional dust-collecting device can be connected to an air vent at the top of the conduit 51 of charger 50 to dispose of any dust or effluent generated during the course of the charging process.

The control logic for charging and vertical positioning of the charger 50, its conduit 51, and the charge-well cover 30 comprises two separate functions. The first function controls the melt rate, which is first manually selected by adjusting the speed of the scrap feed conveyor 70. The low-level sensor **51*b* slows the feed conveyor 70 down to low speed if the column of scrap built up in the charger conduit 51 reaches its level. The high-level sensor 51*a* is an over level sensor which simply shuts off the feed conveyor 70 when the column reaches its height, because the furnace cannot melt the scrap feed 80** at the rate at which it is then being charged.

Figure 1:
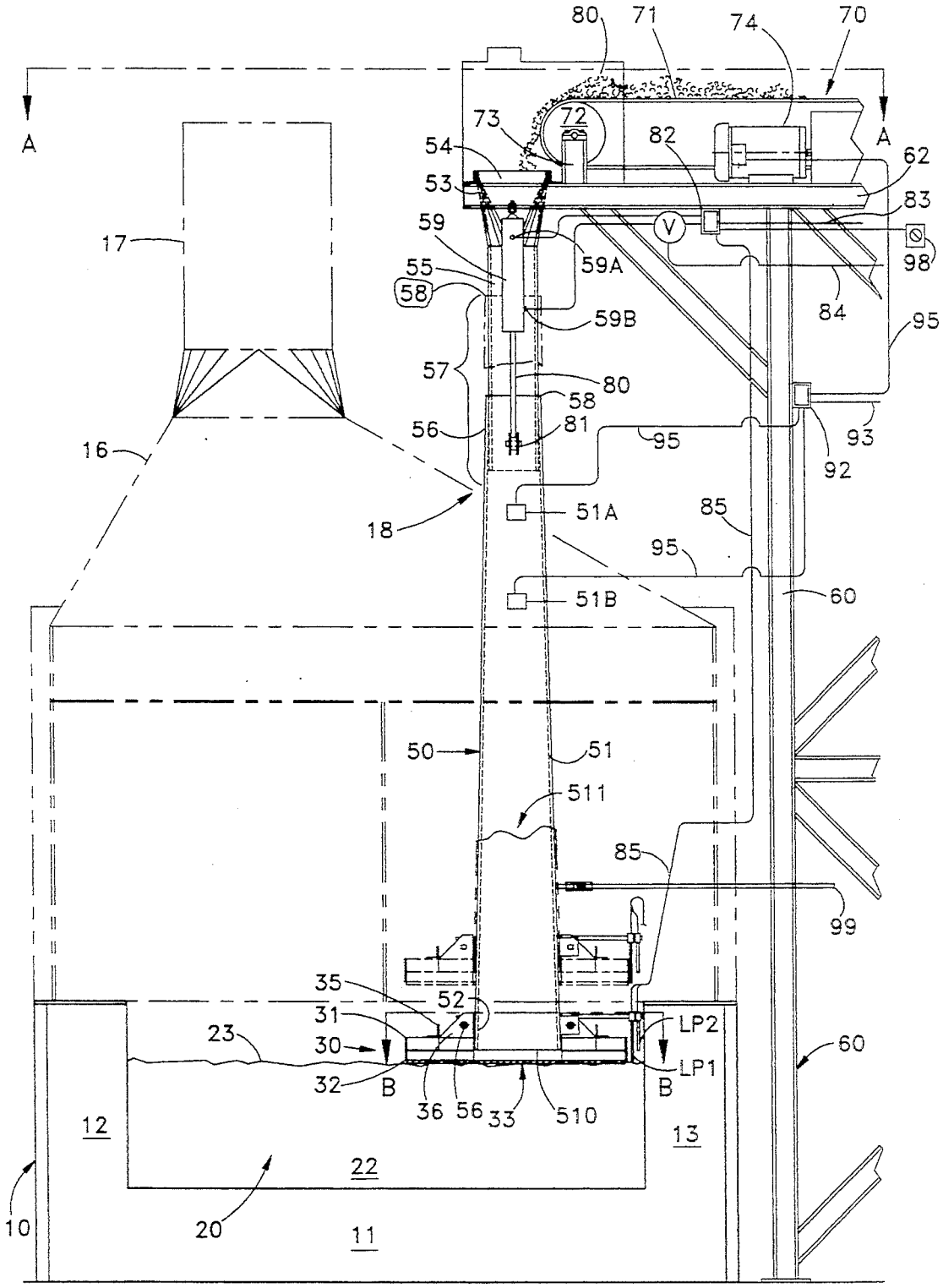
FIG. 1 is a side elevational view, partially schematic and partially in section, showing apparatus according to the invention and illustrating the method of the invention in association with the charge well of a reverberatory furnace, the mass flow gravity feed charger and charge-well cover combination of the invention being clear from this Figure.

The second control function controls the vertical level of the conduit 51 of furnace charger 50 and the associated charge well cover 30 so that the refractory-lined bottom portion 32 of the cover 30 is at all times during charging essentially in contact with the upper surface 23 of the molten metal pool 22. A manual retract override switch 98 causes the charger 50 with attached cover 30 to be raised to an out-of-service position, illustratively shown in shadow lines in FIG. 1, when desired. A low-voltage conductive probe LP1 comes into contact with the surface 23 of molten metal bath 22 signalling the furnace charge well cover 30 to stop its downward motion. The cover 30 then retracts automatically approximately three-sixteenths (3/16) of an inch and stops. As the molten metal 22 rises due to the melting of the metal scrap 80 being charged through charger 50, the molten metal 22 surface 23 rises and again comes into contact with the probe LP1, whereupon the cover retracts a further three-sixteenths (3/16) of an inch. If the molten metal 22 upper surface 23 does not come into contact with the probe LP1 within approximately the same unit of time (e.g., fifteen (15) minutes), the automatic level control 82 sends the furnace charger 50 with attached cover 30 down again until it finds the new molten metal level, i.e., the molten metal upper surface 23 in the charge well cavity 20. This level 23 varies not only with the continued input of metal scrap 80, but also because of frequent removal of molten metal from the furnace.

Sensor LP1 thus senses the presence of the upper surface 23 of the molten metal 22 in charge well cavity 20 and then triggers a small rise of charge-well cover 30 to a position slightly thereabove. After a short delay, charge-well cover 30 is sent downwardly until sensor LP1 again senses the presence of upper surface 23 of molten metal 22, at which point the descent of charge-well cover 30 is stopped and whereafter it again rises to a position which is a short distance above upper surface 23 of molten metal 22 in charge-well cavity 20. This procedure is repeated so at all times to keep charge-well cover 30 positioned essentially in contact with upper surface 23 of molten metal 22 in charge-well cavity 20 or a short distance thereabove.

Sensor LP2 performs the same function as sensor LP1 in exactly the same way and is merely a redundant or backup sensor which comes into play only in the event of failure of the first sensor LP1.

The automatic charge well cover logic comprises conductive probes LP1 and LP2, control 82 including a timing sequence and electrical solenoid valves, and air or pneumatic cylinders 59 to raise and lower the lower slidable portion 56 of conduit 51 and the attached cover 30 and to maintain the refractory bottom layer 32 of cover 30 essentially in contact with the upper surface 23 of the molten metal pool 22 at all times during charging of metal scrap 80 thereinto.

IN GENERAL

Suitable materials of construction for the charger conduit 51 are mild steel or stainless steel depending on the temperature zone involved and abrasion-resistant steel in areas of higher wear. The charge-well cover 30 metal cover plate 31 is normally constructed of approximately 304 stainless steel because of the high temperatures generated in the location of its application, to which an approximately two (2) inch thick ceramic board is attached as ceramic layer 32 to the bottom thereof. One satisfactory refractory board is a product of Pyro Tech and is a nonwetting material. For best results, the stainless steel cover plate 31 and the refractory material 32 should be replaced at least every six (6) months of operation, but such replacement involves only a nominal cost.

When presized metal scrap feed 80 was introduced into the upper loading aperture 54 of the charger conduit 51 at a rate ranging from about five (5) pounds per minute to about sixty (60) pounds per minute, the level of scrap metal feed 80 within the charger conduit interior 511 remained between about 36 inches and 48 inches above the upper surface 23 of the molten metal pool 22, in this test molten aluminum, throughout a two (2)-hour test. During the last one and one-half hours, scrap metal feed at a rate of twenty (20) pounds per minute average was found satisfactory. The density of the metal scrap, in this case aluminum, being fed was 46 pounds per cubic foot. A collection of semi-molten aluminum below the charge-well cover 30 remained fairly constant at about 12 to 15 inches below the upper surface 23 of the molten metal bath 22 in the charge-well cavity 20.

The present invention therefore provides a simplified method and apparatus for the introduction of flowable metal scrap into a molten bath of the same or similar metal, or for alloying the metal in the molten metal bath of the charge well of a metal-melting furnace, and the method and apparatus of the invention is particularly valuable when employed in conjunction with the type of charge-well cover which is the subject matter of U.S. Pat. No. 5,211,744. The fundamental objective of the present invention is for introducing presized metal scrap on a continuous or semi-continuous basis to and below the surface of a molten metal bath through an aperture in the charge-well cover which corresponds to the bottom opening of a cylindrical or other elongated conduit which constitutes an essential element of the mass flow gravity feed furnace charger means of the invention. The method operates in a highly efficient manner while minimizing melt loss by oxidation or otherwise. The apparatus and method can be employed in both ferrous and non-ferrous metal industries and is useful for delivering and introducing finely-divided or in any event presized metal scrap feed material such as metal chips, shavings, screened or shredded scrap, such as result from the employment of a large hammermill, or entire castings, and the size of the scrap metal feed is restricted only by the upper loading aperture or apertures provided atop the vertical conduit of the apparatus of the present invention.

PRINCIPLE OF OPERATION

As is well known, metal scrap has a tendency to float at the top of a molten metal bath of the same or similar material. The most efficient way to melt scrap metal is therefore to deliver it below the surface of the metal bath, where the high temperature of the molten metal and the absence of oxygen results in a rapid change of state from solid to liquid with a minimum of melt loss. The mass flow gravity feed furnace charger of the present invention permits accumulation of a sufficient quantity of metal scrap material in the interior of a substantially vertical column in a conduit or "silo" situated above the surface of the molten metal so that, when the weight balance between the column of metal scrap and the specific gravity of the molten metal in the charge well is overcome, the column of metal scrap then automatically submerges itself further into the molten metal bath. By continuously or semi-continuously delivering the presized scrap metal into the top of the charger conduit or "silo", the weight of the column built of metal scrap is again and again or continuously built up therein until the weight of the column of metal scrap overcomes the resistance of the molten metal bath surface and the column of metal scrap automatically moves further down into the molten metal bath proper. Experimental trials to date have indicated that a scrap metal weight between about forty (40) to seventy-five (75) percent of the molten metal weight per cubic foot is required for continuous submergence of the column of metal scrap material into the molten metal.

An interface exists between the molten metal and the unmelted metal scrap which has just been submerged. It is common to expect a column of metal scrap to exist for a foot or more below the surface of the molten metal bath. Most of this partially-melted inventory of metal scrap lies just under the furnace cover. The charge rate of metal scrap into any metal-melting furnace must be controlled in order to prevent the accumulation of unmelted scrap material below the furnace cover from reaching the floor of the furnace or plugging of the metal-circulating channels or arches between the commonly-used external charge well and the internal main chamber of the furnace. To provide the most desirable conditions for the melting of metal scrap into a molten metal pool of the same or similar metal, not only is a heat-resistant cover over the charge well of the furnace highly desirable, but also the presence of an inert gas. Considerable inert gas will be evolved from the burning off of oily or greasy contaminants of scrap metal charged into the molten metal pool, but an inert gas supply is preferably also provided to provide a non-oxidizing atmosphere. In the present case, the inert gas supply is introduced into the column of metal scrap near the surface of the molten metal pool in the charge well for displacement of free oxygen contained in the void areas which exist in the column of metal scrap by a non-oxidizing inert gas. Meanwhile, the refractory-lined bottom surface of the charge-well cover is maintained in contact with the upper surface of the molten metal pool in the charge well, thereby to provide an air seal so that the inert gas can provide a positive pressure inside of the vertical conduit and the column of metal scrap contained therein so as to cause the flow of oxygen-containing air and some nitrogen to move upwardly and eventually to exit from the top of the vertical conduit or "silo" which is an integral part of the mass flow gravity feed furnace charger means of the present invention.

It is thereby seen from the foregoing that the objects of the present invention have been accomplished and that a novel, efficient, and economic method and apparatus for the introduction of presized metal scrap into a molten metal pool, especially metal of which said scraps are formed or an alloy thereof, has been provided, all in accord with the Summary of the Invention as set forth hereinbefore.

It is to be understood that the present invention is not to be limited to the exact details of operation, or to the exact compounds, compositions, methods, procedures, or embodiments shown and described, as various modifications and equivalents will be apparent to one skilled in the art, wherefore the present invention is to be limited only by the full scope which can be legally accorded to the appended claims.

I claim:

1. A mass flow gravity feed furnace charger for use in conjunction with the charge well of a metal-melting furnace comprising the following elements in combination:

a heat-resistant charge-well cover adapted to lie essentially in contact with the upper surface of molten metal in the charge well of a metal-melting furnace and adapted to cover a substantial portion of the charge well and having an aperture therein and therethrough;

means for forming a substantially vertically-oriented column of metal scrap within and above said aperture;

means for feeding additional metal scrap to said column to increase the height and weight thereof;

whereby the height and weight of said column can be increased until the weight thereof gravitationally forces said metal scrap at the bottom of said column into the molten metal mass in said charge well.

2. A mass flow gravity feed furnace charger of claim 1 for use in conjunction with the charge well of a metal-melting furnace comprising the following elements in combination:

a heat-resistant charge-well cover adapted to lie essentially in contact with the upper surface of molten metal in the charge well of a metal-melting furnace and adapted to cover a substantial portion of the charge well and having an aperture therein and therethrough;

an elongated substantially vertically-oriented scrap metal feed conduit having a hollow interior and an upper and lower portion;

metal scrap feed means in association with said upper portion of said conduit and adapted to feed metal scrap thereinto;

said lower portion of said conduit being in association with said charge-well cover and the hollow interior thereof being in communication with the aperture in said charge-well cover;

whereby metal scrap can be loaded into the upper portion of said conduit and collected within said conduit until the weight thereof gravitationally forces said metal scrap into the molten metal mass in said charge well.

3. Apparatus of claim 2, wherein at least the lower portion of said conduit and associated charge-well cover are moveable vertically into and out of proximity to and contact with the upper surface of the molten metal in the charge well and including means for effecting such movement.

4. Apparatus of claim 3, including hydraulic or pneumatic means for effecting said movement.

5. Apparatus of claim 2, wherein said conduit comprises two separate sections, an upper section and a lower section.

6. Apparatus of claim 5, wherein portions of said sections are in up and down moveable relationship with respect to each other.

7. Apparatus of claim 6, wherein portions of said sections are in slidable up and down moveable relationship with respect to each other and including hydraulic or pneumatic means for effecting said up and down movement with respect to each other.

8. Apparatus of claim 7, wherein said pneumatic or hydraulic means is activated by one or more probes associated with the level of molten metal in said charge well.

9. Apparatus of claim 8, wherein said up and down movement is activated so as to maintain said charge-well cover at the bottom of said conduit essentially in contact with the upper surface of molten metal in said charge well.

10. Apparatus of claim 2, wherein said conduit is supported by support means at an upper end thereof.

11. Apparatus of claim 10, wherein an upper end of said conduit is secured to a horizontal portion of said support means.

12. Apparatus of claim 2, wherein an opening at an upper end of said conduit is enlarged to facilitate the introduction of metal scrap thereinto.

13. Apparatus of claim 6, wherein said conduit comprises an upper fixed section and a lower section in slidable relation thereto over a portion thereof, to enable relative up and down movement of said lower section with relation to said upper fixed section.

14. Apparatus of claim 13, wherein said relative up and down movement is effected by fluid-actuated cylinders connected to one of said sections having outwardly-extending piston rods connected to the other of said sections.

15. Apparatus of claim 3, wherein said movement is controlled with relation to the level of molten metal in said charge well by a sensor associated with said charge well cover at the bottom of said conduit.

16. Apparatus of claim 14, wherein said movement is controlled with relation to the level of molten metal in said charge well by a sensor associated with said charge well cover at the bottom of said conduit.

17. Apparatus of claim 15, wherein said sensor activates said charge-well cover to descend, stop descent upon contact with the upper surface of molten metal in said charge well, rise a short distance, and then to descend a predetermined distance after a predetermined period.

18. Apparatus of claim 2, wherein said conduit is secured to said heat-resistant charge-well cover.

19. Apparatus of claim 2, comprising an inert gas inlet into the interior of said conduit.

20. Apparatus of claim 2, comprising a feed sensor associated with said conduit for controlling introduction of metal scrap feed into the conduit.

21. Apparatus of claim 20, comprising upper and lower feed sensors associated with said conduit for slowing metal scrap feed into the conduit when a column of metal scrap built up in the conduit reaches the level of said lower sensor and for shutting off metal scrap feed when a column of metal scrap built up in the conduit reaches the level of said upper level sensor.

22. Apparatus of claim 2, comprising a retract switch and associated circuitry for raising the conduit and associated charge-well cover to an out-of-service position above the charge well.

23. Apparatus of claim 2, in place atop the charge well of a metal-melting furnace wherein the molten metal and the scrap charged thereinto comprises aluminum, magnesium, titanium, brass, iron, or steel, or an alloy thereof, or a metal for alloying one of said metals.

24. A method for the introduction of metal scrap by mass flow gravity feed into molten metal in a charge well of a metal-melting furnace comprising the following steps:

providing a heat resistant charge-well cover adapted to cover a substantial portion of the charge well and having an aperture therein and therethrough;

forming a substantially vertically-oriented column of metal scrap within and above said aperture;

feeding additional metal scrap to said column to increase the height and weight thereof; and increasing the height and weight of said column until the weight thereof gravitationally forces said metal scrap at the bottom of said column into the molten metal mass in said charge well.

25. A method of claim 24 for the introduction of metal scrap by mass flow gravity feed into molten metal contained in the charge well of a metal-melting furnace comprising the following steps:

providing a heat-resistant charge-well cover adapted to lie essentially in contact with the upper surface of molten metal in the charge well of a metal-melting furnace and adapted to cover a substantial portion of the charge well and having an aperture therein and therethrough;

providing means for forming a substantially vertically-oriented column of scrap metal within and above said aperture;

providing means for feeding additional metal scrap to said column to increase the height and weight thereof;

forming said column and feeding said additional scrap;

thereby increasing the height and weight of said column until the weight thereof gravitationally forces said metal scrap at the bottom of said column into the molten metal mass in said charge well.

26. A method of claim 25, including the steps of:

providing a heat-resistant charge-well cover adapted to lie essentially in contact with the upper surface of molten metal in the charge well of a metal-melting furnace and adapted to cover a substantial portion of the charge well and having an aperture therein and therethrough;

providing an elongated substantially vertically-oriented scrap metal feed conduit having a hollow interior and an upper and lower portion;

providing metal scrap feed means in association with said upper portion of said conduit and adapted to feed metal scrap thereinto;

said lower portion of said conduit being in association with said charge-well cover and the hollow interior thereof being in communication with the aperture in said charge-well cover; and loading presized metal scrap into the upper portion of said conduit and collecting said metal scrap within said conduit until the weight thereof gravitationally forces said metal scrap into the molten metal mass in said charge well.

27. A method of claim 26 including the step of moving at least the lower portion of said conduit and associated charge-well cover vertically into and out of proximity and contact with the upper surface of the molten metal in the charge well.

28. A method of claim 27, wherein said movement is effected hydraulically or pneumatically.

29. A method of claim 26, wherein said conduit comprises two separate sections, an upper section and a lower section, and wherein portions of said sections are in up and down moveable relationship with respect to each other, and including the step of moving said sections with respect to each other.

30. A method of claim 26, wherein said conduit comprises two separate sections, an upper section and a lower section, wherein portions of said sections are in up and down moveable relationship with respect to each other, and including the step of effecting said up and down movement with respect to each other hydraulically or pneumatically.

31. A method of claim 30, including the step of activating said pneumatically or hydraulically effected movement in relation to the level of molten metal in said charge well.

32. A method of claim 31, wherein said up and down movement is activated so as to maintain said charge-well cover at the bottom of said conduit essentially in contact with the upper surface of molten metal in said charge well.

33. A method of claim 30, wherein said conduit comprises an upper fixed section and a lower section in slidable relation thereto over a portion thereof, to enable relative up and down movement of said lower section with relation to said upper fixed section.

34. A method of claim 33 including the step of effecting said relative up and down movement by fluid-actuated cylinders connected to one of said sections having outwardly-extending piston rods connected to the other of said sections.

35. A method of claim 33, including the step of controlling said up and down movement with relation to the level of molten metal in said charge well.

36. A method of claim 35, including the steps of stopping descent of said cover upon contact with the upper surface of molten metal in said charge well and stopping ascent of said charge-well cover in said charge well after a predetermined rise.

37. A method of claim 36, including the step of activating said charge-well cover to descend a predetermined distance after a predetermined period.

38. A method of claim 26 including the step of introducing an inert gas into the interior of said conduit.

39. A method of claim 26, including the step of controlling the rate of introduction of scrap metal feed into the conduit.

40. A method of claim 39 including the steps of slowing scrap metal feed into the conduit when a column of metal scrap built up in the conduit reaches a first level and shutting off metal scrap feed when a column of metal scrap built up in the conduit reaches a second and higher level.

41. A method of claim 26, wherein the molten metal and the metal scrap charged thereinto comprises aluminum, magnesium, titanium, brass, iron, or steel, or an alloy thereof, or a metal for alloying one of said metals.

* * * * *